US006283117B1

(12) United States Patent
Chiang

(10) Patent No.: US 6,283,117 B1
(45) Date of Patent: Sep. 4, 2001

(54) CASING OF A KITCHEN RANGE HOOD

(76) Inventor: Pi Tang Chiang, No. 402, Chung Shan Road, Sheng Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/696,285

(22) Filed: Oct. 26, 2000

(51) Int. Cl.[7] ..... F24C 15/20
(52) U.S. Cl. ..... 126/299 R; 126/299 D
(58) Field of Search ..... 126/299 R, 299 D, 126/300–303, 21 R, 299 C; 55/DIG. 36

(56) References Cited

U.S. PATENT DOCUMENTS 1,477,590 * 12/1923 Powell ..... 126/299 D
1,740,668 * 12/1929 Schierer ..... 126/302
1,827,956 * 10/1931 Sharpe ..... 126/299 D

* cited by examiner

*Primary Examiner*—James C. Yeung
(74) *Attorney, Agent, or Firm*—Bacon & Thomas, PLLC

(57) ABSTRACT

A casing of a kitchen range hood includes a quarter-sphere casing which has a first semi-sphere circumference from which a flat surface is defined on the casing and a hole is defined through the flat surface so as to be connected with a pipe, and a second semi-sphere circumference from which a flange extends radially outward so as to be connected to a oil collection device. An aperture is defined through the quarter-sphere casing and a switch is engaged with the aperture. A support board extends inward from a rear plate of the quarter-sphere casing and a motor with fans are supported on the support board.

2 Claims, 4 Drawing Sheets

CASING OF A KITCHEN RANGE HOOD

FIELD OF THE INVENTION

The present invention relates to a casing of a kitchen range hood wherein the casing is a quarter of a spherical shell and oil particles will not be stuck on the smooth surface.

BACKGROUND OF THE INVENTION

A conventional casing 10 kitchen range hood is shown in FIG. 1 and generally includes a main plate 11 which has a hole for connection a pipe, two side plates 12 which are connected to two ends of the main plate 11 by way of welding or riveting along flanges on the periphery of the side plates 12, and a rear plate 13 which is connected to the main plate 11 and the two side plates 12 by the same way as the connection of the side plates 12 and the main plate 11. Each of the main plate 11, the two side plates 12 and the rear plate 13 are made separately and the respective flanges are made so as to connect to each other. The manufacturers have to spend a lot of time to cut, punch, bend and weld these separate items. Of more importance is that the convention casing 10 involves many angled or narrow corners or areas and splits which stock oil particles and are difficult to clean.

SUMMARY OF THE INVENTION

In accordance with one aspect of the present invention, there is provided a casing of a kitchen range hood and comprising a quarter-sphere casing which includes a first semi-sphere circumference and a second semi-sphere circumference. A flat surface is defined in the casing and communicates with the first semi-sphere circumference. A hole is defined through the flat surface. A flange extends radially outward from the second semi-sphere circumference and an aperture is defined through the quarter-sphere casing. A support board extends inward from a rear plate of the quarter-sphere casing for a motor and fans supported thereon.

The primary object of the present invention is to provide a casing for a kitchen range hood wherein the casing is easily to made and requires less welding or riveting processes.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
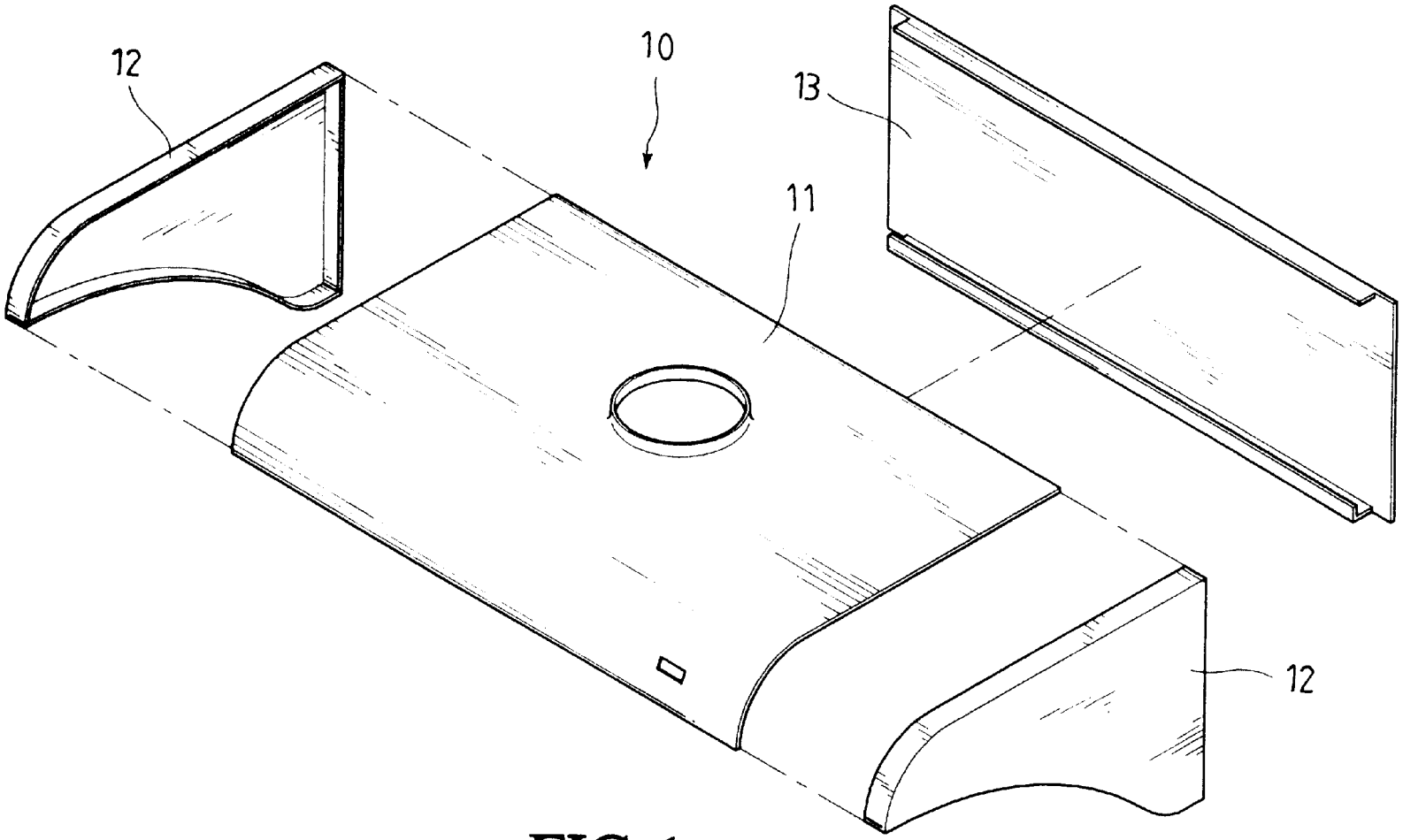
FIG. 1 PRIOR ART
FIG. 1 is an exploded view to show a conventional casing for kitchen range hood.
Figure 2:
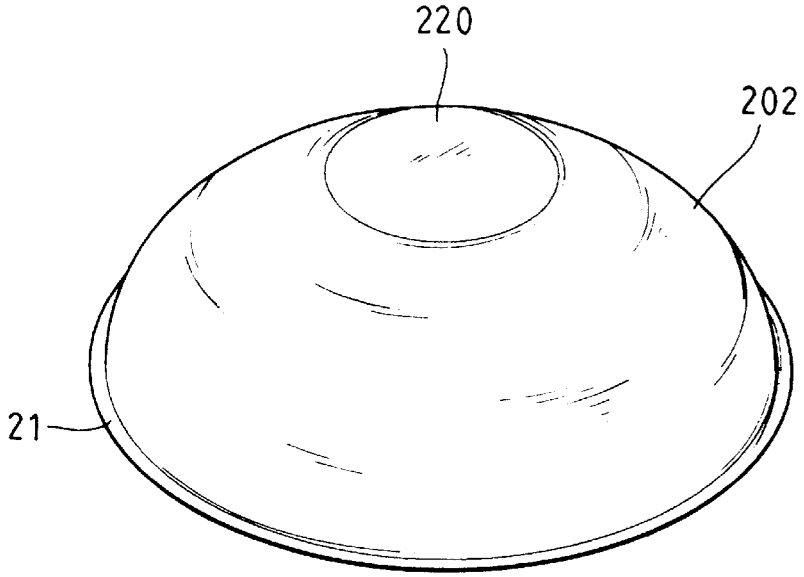
FIG. 2 is a perspective view to show a semi-sphere casing which is to be equally cut into two quarter-sphere casings for kitchen range hood of the present invention.
Figure 3:
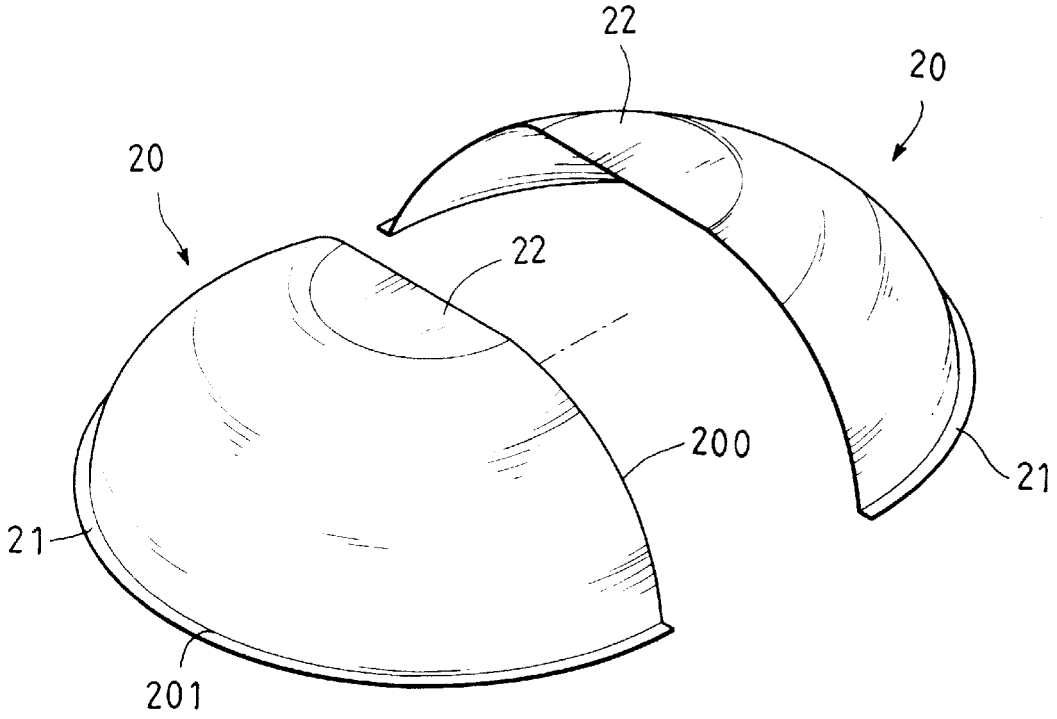
FIG. 3 shows the two quarter-sphere casings for kitchen range hood of the present invention.
Figure 4:
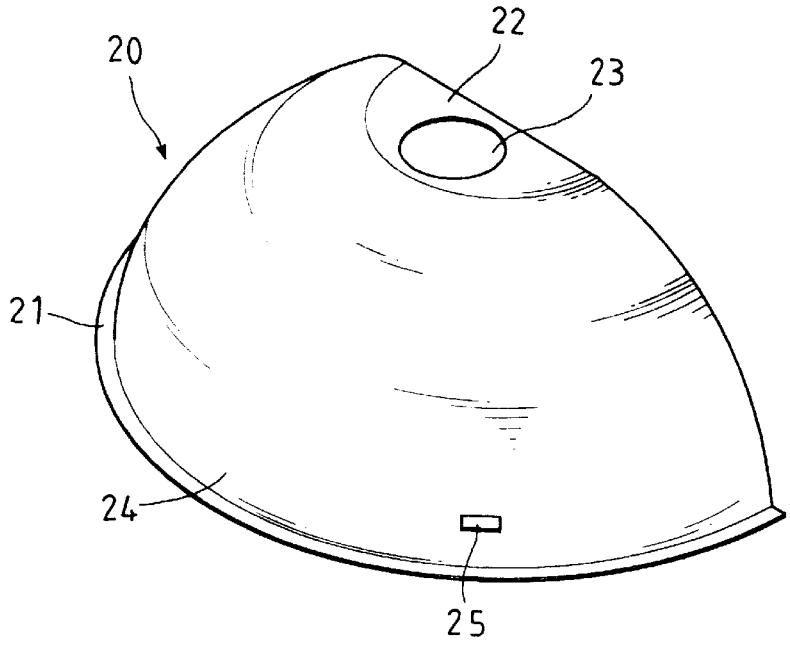
FIG. 4 is a perspective view to show the quarter-sphere casing for kitchen range hood of the present invention, wherein a hole and an aperture are respectively punched.
Figure 6:
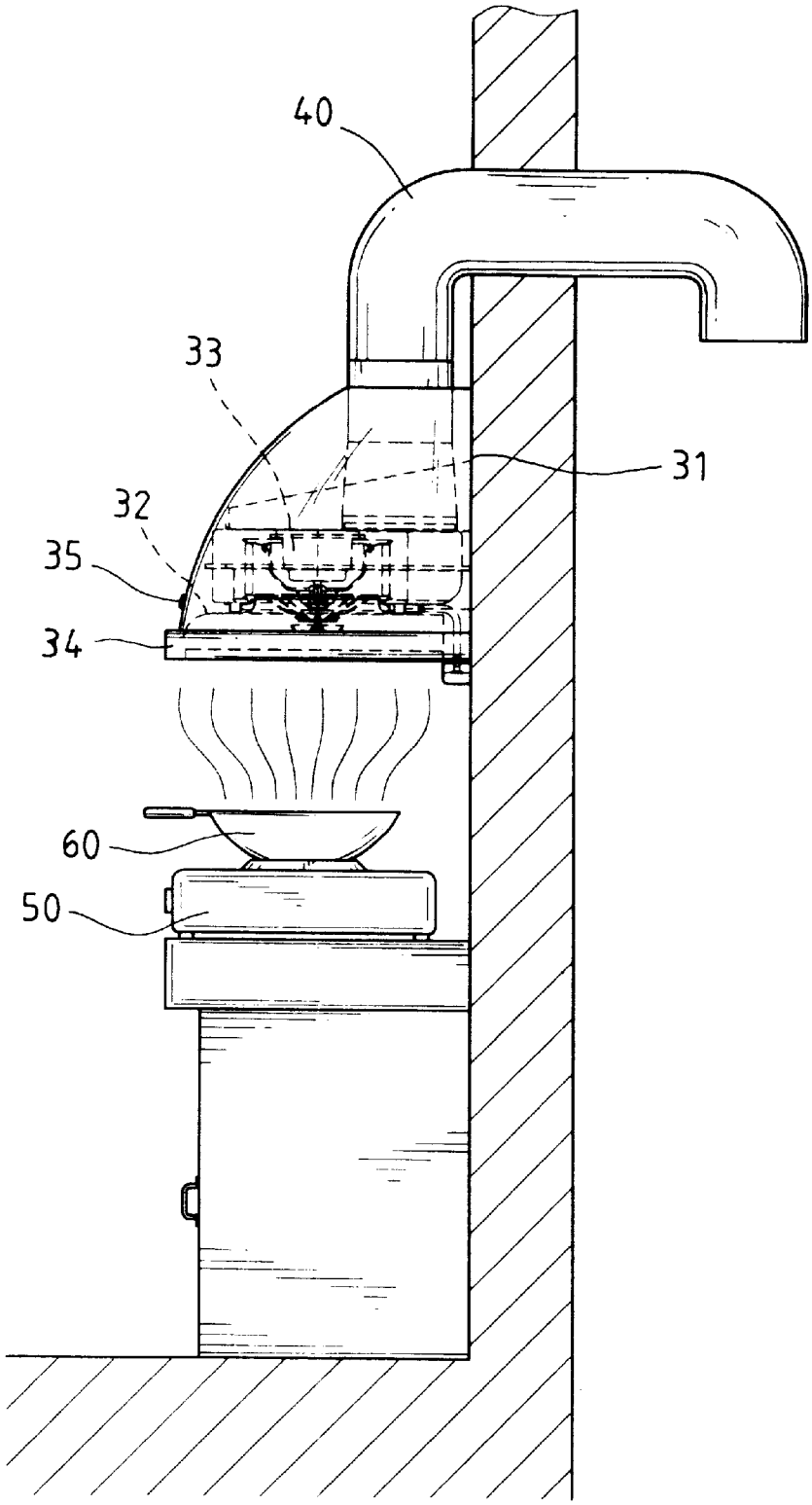
FIG. 6 illustrates a kitchen range hood employing the casing of the present invention connected to a wall.

Referring to FIGS. 2 to 4 and 6, the casing for kitchen range hood of the present invention comprises a quarter-sphere casing 20 which is equally cut from a semi-sphere casing 202 as shown in FIG. 2 so that each quarter-sphere casing 20 includes a first semi-sphere circumference 200 and a second semi-sphere circumference 201. A circular flat surface 220 is defined on a top portion of the semi-sphere 202 before being cut so that a flat surface 22 is defined in each of the quarter-sphere casings 20 and the flat surface 22 communicates with the first semi-sphere circumference. A hole 23 is defined through the flat surface 22 so as to be connected to a pipe 40 as shown in FIG. 6. A flange 21 extends radially outward from the second semi-sphere circumference 201 which is advantageous for installing a oil collection device 34 as shown in FIG. 6.

An aperture 25 is defined through the quarter-sphere casing 20 and a switch 35 is engaged with the aperture 25. A rear plate 31 is connected to the first circumference 200 so as to be fixedly on a wall to position the kitchen range hood on the wall. A support board 32 extends inward from the rear plate 31 of the quarter-sphere casing 20 and the support board 32 includes a central hole so that a motor 33 is supported on the support board 32 and fans are accessed from the central hole in the support board 32. As shown in FIG. 6, the kitchen range hood is located above the cook top or kitchen counter, a gas burner 50 is put on the cook top of the kitchen counter and a pot 60 is heated on the gas burner 50. The smoke involving many oil particles is sucked by the fans and flows out from the pipe 40. It is to be noted that the casing 20 of the present invention has a smooth inner periphery and outer periphery 24 so that few oil particles can stuck or adhered to the casing 20. The casing 20 is easily made by pressing a metal plate and only two punching processes are required so as to meet the requirements of mass production.

Figure 5:
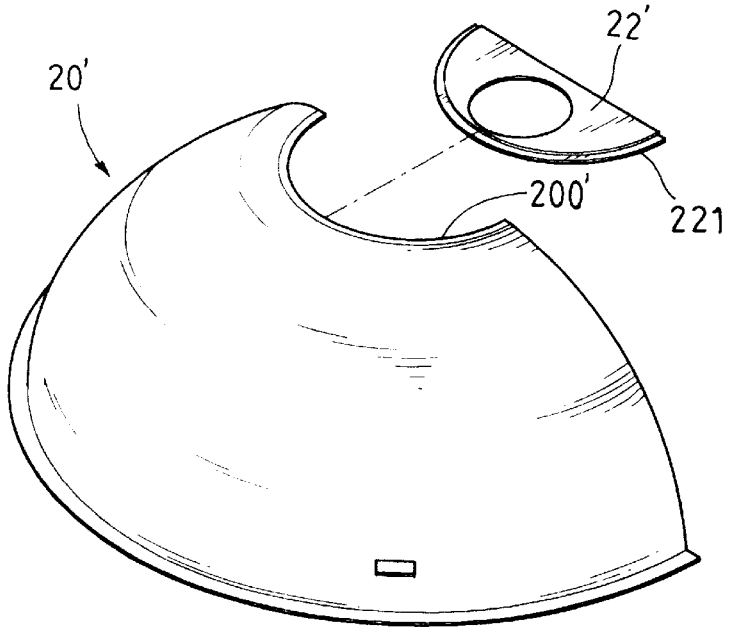
FIG. 5 is an exploded view to show another embodiment of the quarter-sphere casing for kitchen range hood of the present invention.

FIG. 5 shows another embodiment of the casing wherein the quarter-sphere casing 20' and the flat surface 22' are two separated items which are connected to each other. The flat surface 22' has a lip 221 extending from a lower edge thereof and the lip 221 is welded to an inner surface of a recess 200' defined in a top of the casing 20'.

While we have shown and described various embodiments in accordance with the present invention, it should be clear to those skilled in the art that further embodiments may be made without departing from the scope and spirit of the present invention.

What is claimed is:

1. A casing for a kitchen range hood, the casing comprising a quarter-sphere casing which includes a first semi-sphere circumference and a second semi-sphere circumference, a flat surface defined in the casing and communicating with the first semi-sphere circumference, a hole defined through the flat surface for connection to a pipe, a rear plate connected to the first circumference, a support board extending inwardly from the rear plate for supporting a motor, a flange extending radially outwardly from the second semi-sphere circumference for installing an oil collection device, and an aperture formed in the casing for engagement with a switch.

2. The casing of claim 1, wherein the flat surface of the casing is defined by a separate member having the hole formed therethrough and a lip extending from a lower edge thereof, the lip being welded to an inner surface of a correspondingly-shaped recess defined in a top of the casing.

* * * * *